US009366095B2

(12) United States Patent
Stephenson et al.

(10) Patent No.: US 9,366,095 B2
(45) Date of Patent: Jun. 14, 2016

(54) TUBULAR STRING DISPLACEMENT ASSISTANCE

(71) Applicant: HALLIBURTON ENERGY SERVICES, INC., Houston, TX (US)

(72) Inventors: Stanley V. Stephenson, Duncan, OK (US); Jim B. Surjaatmadja, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 337 days.

(21) Appl. No.: 13/951,223

(22) Filed: Jul. 25, 2013

(65) Prior Publication Data

US 2015/0027727 A1 Jan. 29, 2015

(51) Int. Cl.

| | |
|---|---|
| ***E21B 17/20*** | (2006.01) |
| ***E21B 34/14*** | (2006.01) |
| *E21B 34/00* | (2006.01) |

(52) U.S. Cl.

CPC ..... *E21B 17/203* (2013.01); *E21B 34/14* (2013.01); *E21B 2034/002* (2013.01)

(58) Field of Classification Search

CPC ..... E21B 7/24; E21B 7/203; E21B 7/18; E21B 34/10; E21B 34/14; E21B 21/12; E21B 28/00; E21B 31/005

See application file for complete search history.

(56) References Cited

U.S. PATENT DOCUMENTS 5,253,721 A * 10/1993 Lee ..... E21B 7/18 175/73
5,975,209 A 11/1999 McCorry
6,152,222 A 11/2000 Kyllingstad
6,321,836 B2 11/2001 Brett
6,497,278 B1 12/2002 Norris
6,877,566 B2 4/2005 Selinger et al.
7,017,681 B2 3/2006 Ivannikov et al.
7,900,716 B2 3/2011 Ibrahim et al.

(Continued)

FOREIGN PATENT DOCUMENTS

WO 9746787 A1 12/1997

OTHER PUBLICATIONS

Halliburton Energy Services, Inc., "Big John Hydraulic Jar", H09370, dated 2012, 2 pages.

(Continued)

*Primary Examiner* — Jennifer H Gay
*Assistant Examiner* — Steven MacDonald
(74) *Attorney, Agent, or Firm* — Schwegman Lundberg & Woessner, P.A.; Alan Bryson

(57) ABSTRACT

A displacement assistance device can include at least two flow paths in fluid communication with a flow passage, and a blocking member that blocks flow through each flow path in response to the flow through that flow path. A method of assisting displacement of a tubular string can include installing the tubular string, then discharging a blocking member into the tubular string, and flowing a fluid through a flow passage extending longitudinally through a displacement assistance device connected in the tubular string, thereby causing the member to repeatedly block flow through at least two flow paths in succession. A system can include a displacement assistance device connected in a tubular string, the device including at least two flow paths in communication with a flow passage extending through the tubular string, and a blocking member that alternately blocks flow through the flow paths in response to flow through the flow passage.

21 Claims, 5 Drawing Sheets

(56) References Cited

U.S. PATENT DOCUMENTS

| | | | |
|---|---|---|---|
| 2010/0276158 | A1 | 11/2010 | Ingraham |
| 2013/0048300 | A1 | 2/2013 | MacDonald et al. |
| 2013/0133878 | A1 | 5/2013 | Urban et al. |

OTHER PUBLICATIONS

Boots & Coots, "Pulsonix TFA Service", H08330, dated 2013, 2 pages.

International Search Report with Written Opinion issued Oct. 15, 2014 for PCT/US2014/042468, 13 pages.

* cited by examiner

TUBULAR STRING DISPLACEMENT ASSISTANCE

BACKGROUND

This disclosure relates generally to providing assistance for displacing a tubular string and, in one example described below, more particularly provides a way of urging a tubular string to displace in a subterranean well.

It is sometimes desirable to displace a tubular string through a restricted space (such as a wellbore, pipeline, etc.). If the restricted space is horizontal, or at least substantially inclined, then friction can impede displacement of the tubular string through the inclined or horizontal space. In other situations (for example, where a tubular string is relatively flexible), it can be difficult to push the tubular string through a restricted space.

Therefore, it will be appreciated that improvements are needed in the art. Such improvements may be useful whether or not a restricted space in which a tubular string is to be displaced is horizontal or substantially inclined, and whether or not the tubular string is relatively flexible.

DETAILED DESCRIPTION

Figure 1:
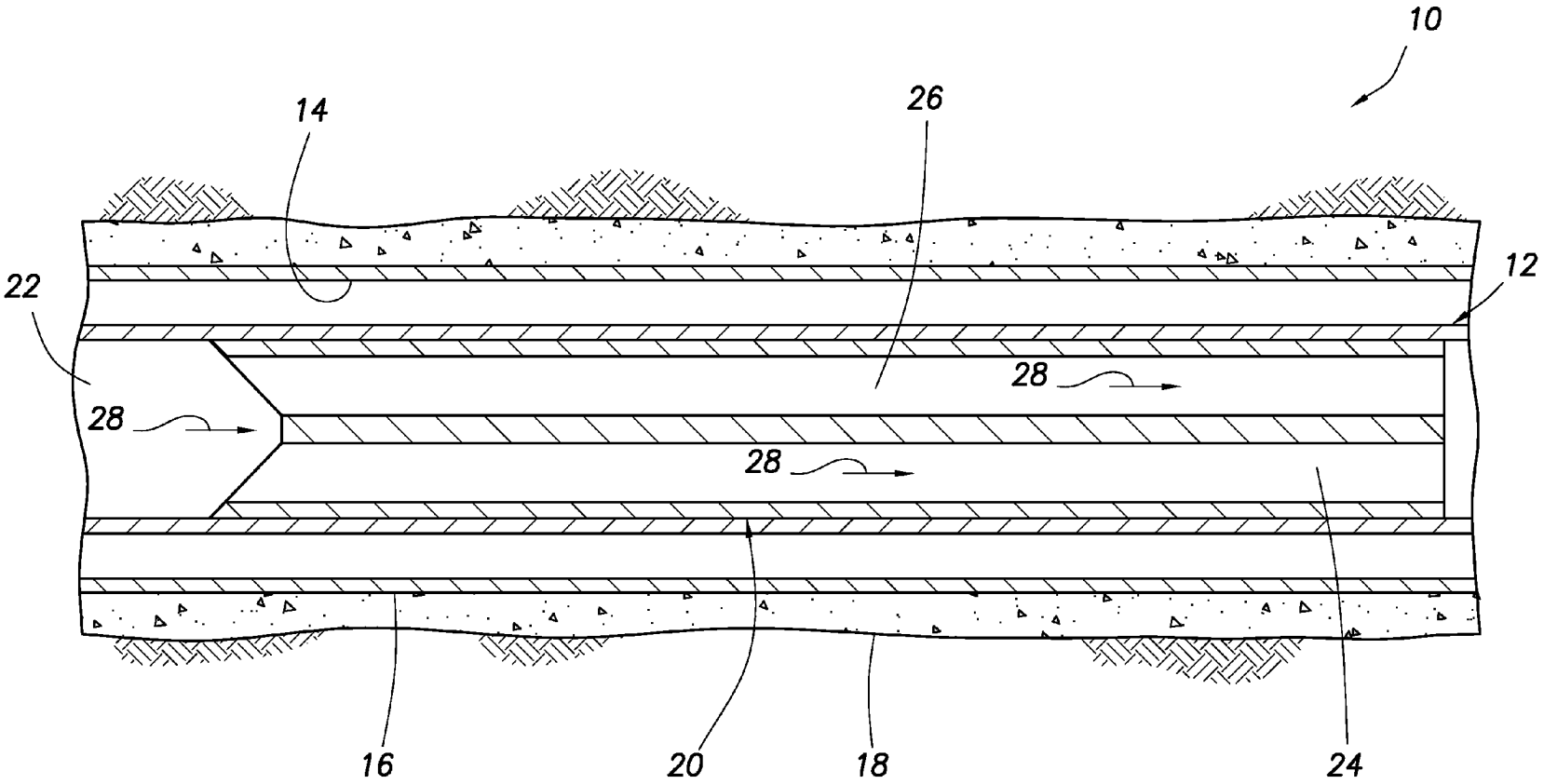
FIG. 1 is a representative partially cross-sectional view of an example well system and associated method which can embody principles of this disclosure.

Representatively illustrated in FIG. 1 is an example system 10 for use with a well, and an associated method, which system and method can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a tubular string 12 is displaced through a generally horizontal portion of a wellbore 14 lined with casing 16 and cement 18. In other examples, the wellbore 14 is not necessarily horizontal, but could be substantially inclined (e.g., greater than about 45 degrees from vertical), and the wellbore is not necessarily lined with casing 16 and cement 18, but could be uncased or open hole.

The tubular string 12 could be any type of elongated generally tubular string, such as, a production tubing string, a drill string, a stimulation or injection string, a work string, etc. The scope of this disclosure is not limited to use of any particular type of tubular string.

In the FIG. 1 example, difficulty can be encountered in displacing the tubular string 12 through the wellbore 14, due in substantial part to friction between the tubular string and the wellbore 14. Other factors could contribute to this difficulty, such as, differential sticking if the wellbore 14 is uncased, lack of sufficient weight of the tubular string in a vertical portion of the wellbore above the substantially inclined portion of the wellbore, etc. However, it should be understood that the scope of this disclosure is not limited to any particular reason for difficulty being encountered in displacing a tubular string through a wellbore.

To mitigate this difficulty, a displacement assistance device 20 is connected in the tubular string 12. In the FIG. 1 example, the device 20 is positioned in a flow passage 22 extending longitudinally through the tubular string 12. In other examples, the device 20 could be provided with connectors at each end thereof for connecting (e.g., via threading) to adjacent elements of the tubular string 12. Thus, the scope of this disclosure is not limited to any particular way of incorporating the device 20 into a tubular string.

The device 20 includes multiple flow paths 24, 26 in fluid communication with, and forming portions of, the passage 22. That is, the flow passage 22 extends longitudinally through the device 20 via the flow paths 24, 26. Although only two of the flow paths 24, 26 are depicted in FIG. 1, any number of flow paths may be used in keeping with the principles of this disclosure.

Each of the flow paths 24, 26 has a flow area that is less than a flow area of the passage 22. If one of the flow paths 24, 26 is blocked, fluid that flows through the other flow path will flow at a greater velocity as compared to the fluid flowing in the passage 22 upstream of the flow paths.

By repeatedly and successively blocking flow through the flow paths 24, 26, relatively high amplitude and low frequency vibrations can be imparted to the tubular string 12 using the device 20, as described more fully below. These vibrations can assist significantly with displacing the tubular string 12 through the wellbore 12.

Figure 2:
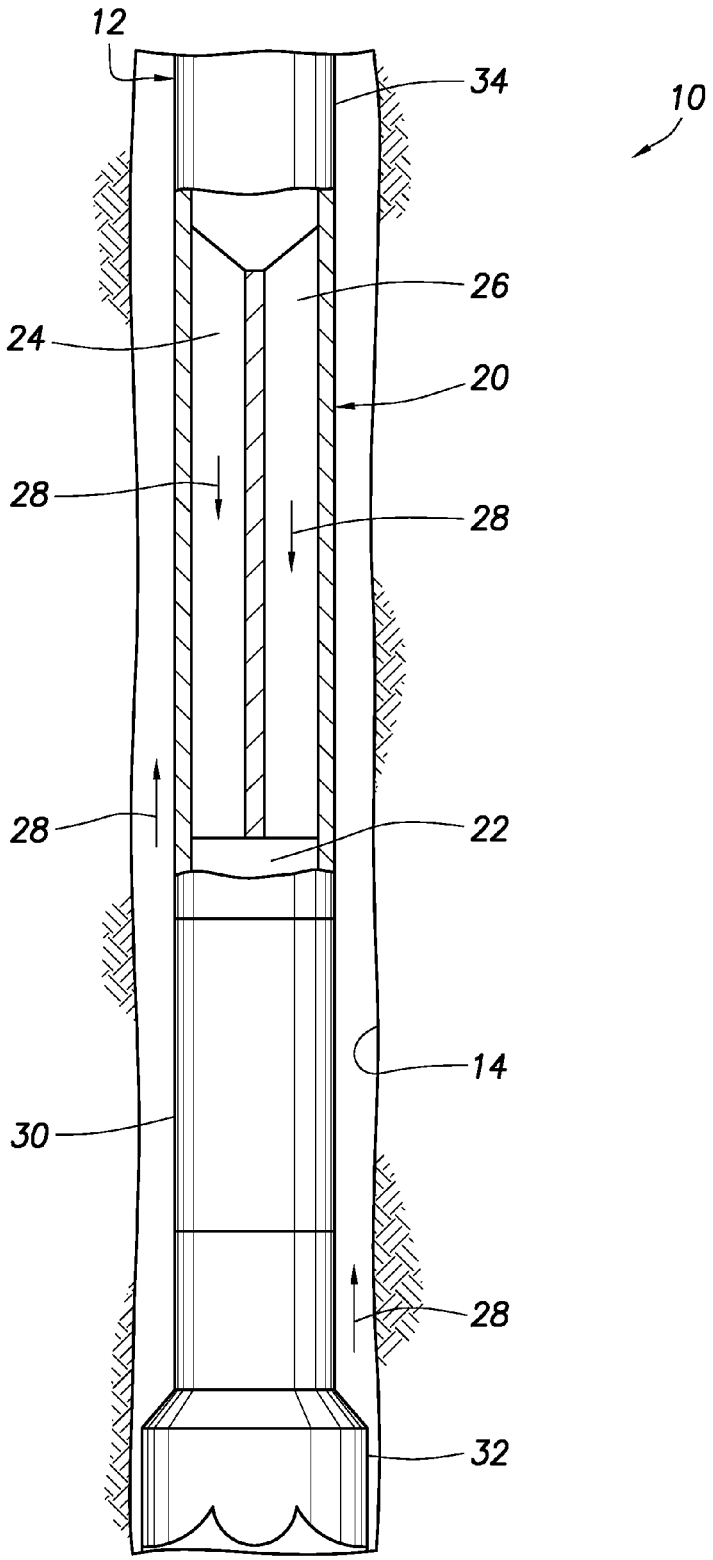
FIG. 2 is a representative partially cross-sectional view of another example well system and associated method which can embody principles of this disclosure.

Referring additionally now to FIG. 2, a partially cross-sectional view of another example of the system 10 and method is representatively illustrated. In this example, the tubular string 12 comprises a drill string used to drill the wellbore 14.

For drilling the wellbore 14, a drilling motor 30 is connected in the tubular string 12 above a drill bit 32 connected at a distal end of the tubular string. The drilling motor 30 rotates the drill bit 32 in response to flow of the fluid 28 through the tubular string 12.

In other examples, the drill bit 32 could be rotated by rotating the tubular string 12. Thus, the scope of this disclosure is not limited to any particular configuration of the tubular string 12, or to any particular way of rotating a drill bit.

In the FIG. 2 example, the tubular string 12 comprises a coiled tubing string 34 above the device 20. "Coiled tubing" is known to those skilled in the art as a continuous, relatively small diameter and flexible tubing, which is typically stored at the earth's surface by coiling onto a spool or reel. It will be appreciated by those skilled in the art that coiled tubing cannot withstand substantial compressive force in order to push the drill bit 32 during drilling operations (coiled tubing that is much smaller than the wellbore 14 can buckle if excessive compressive force is used).

Thus, if coiled tubing is used in the tubing string 12, difficulty can be encountered in displacing the tubular string through the wellbore 14 during drilling operations. This difficulty can be exacerbated if the wellbore 14 is substantially inclined or generally horizontal.

Figure 3:
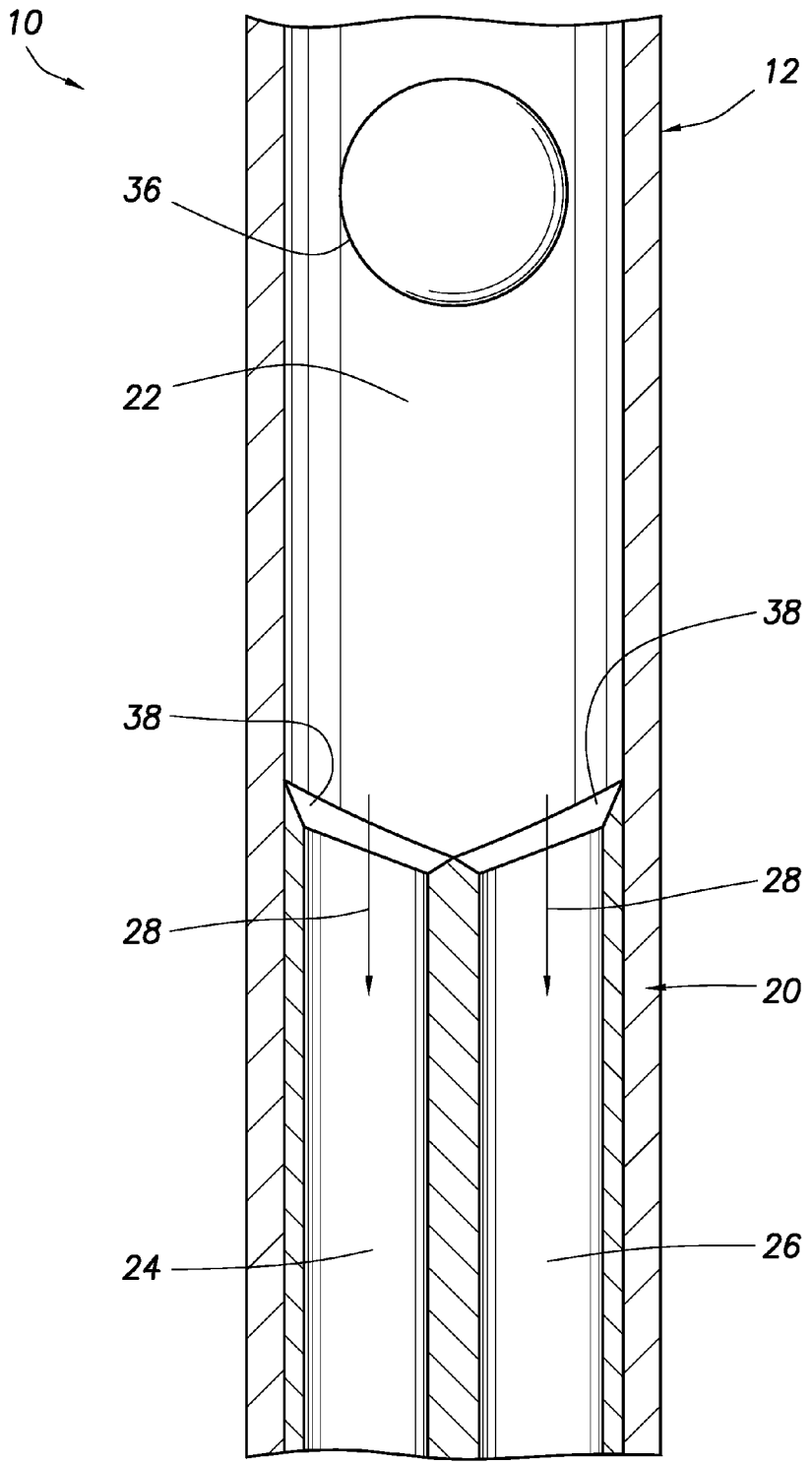
FIGS. 3-5 are representative cross-sectional views of an example displacement assistance device that may be used in the systems and methods of FIGS. 1 & 2, and which can embody the principles of this disclosure.
Figure 4:
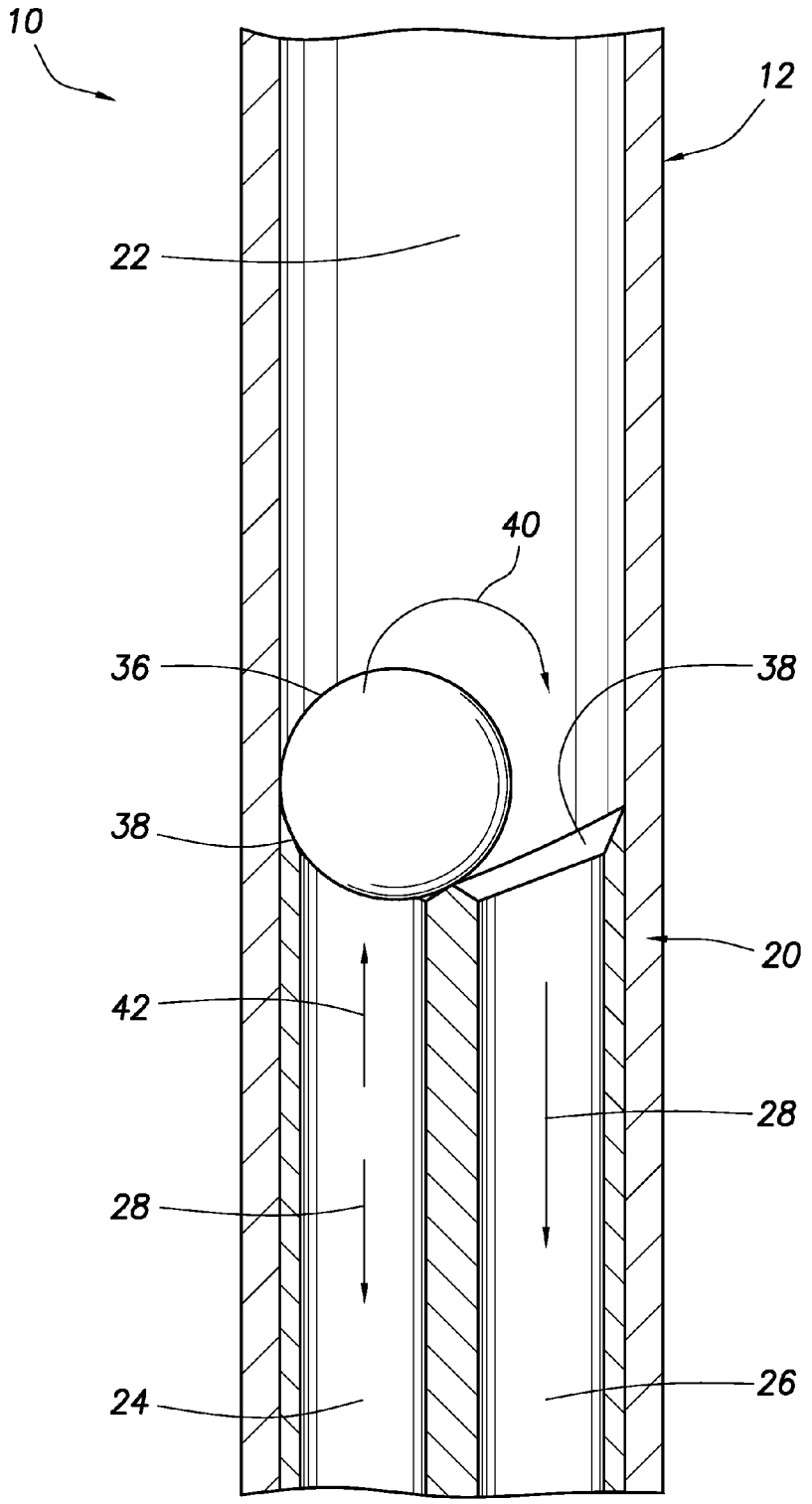
Figure 5:
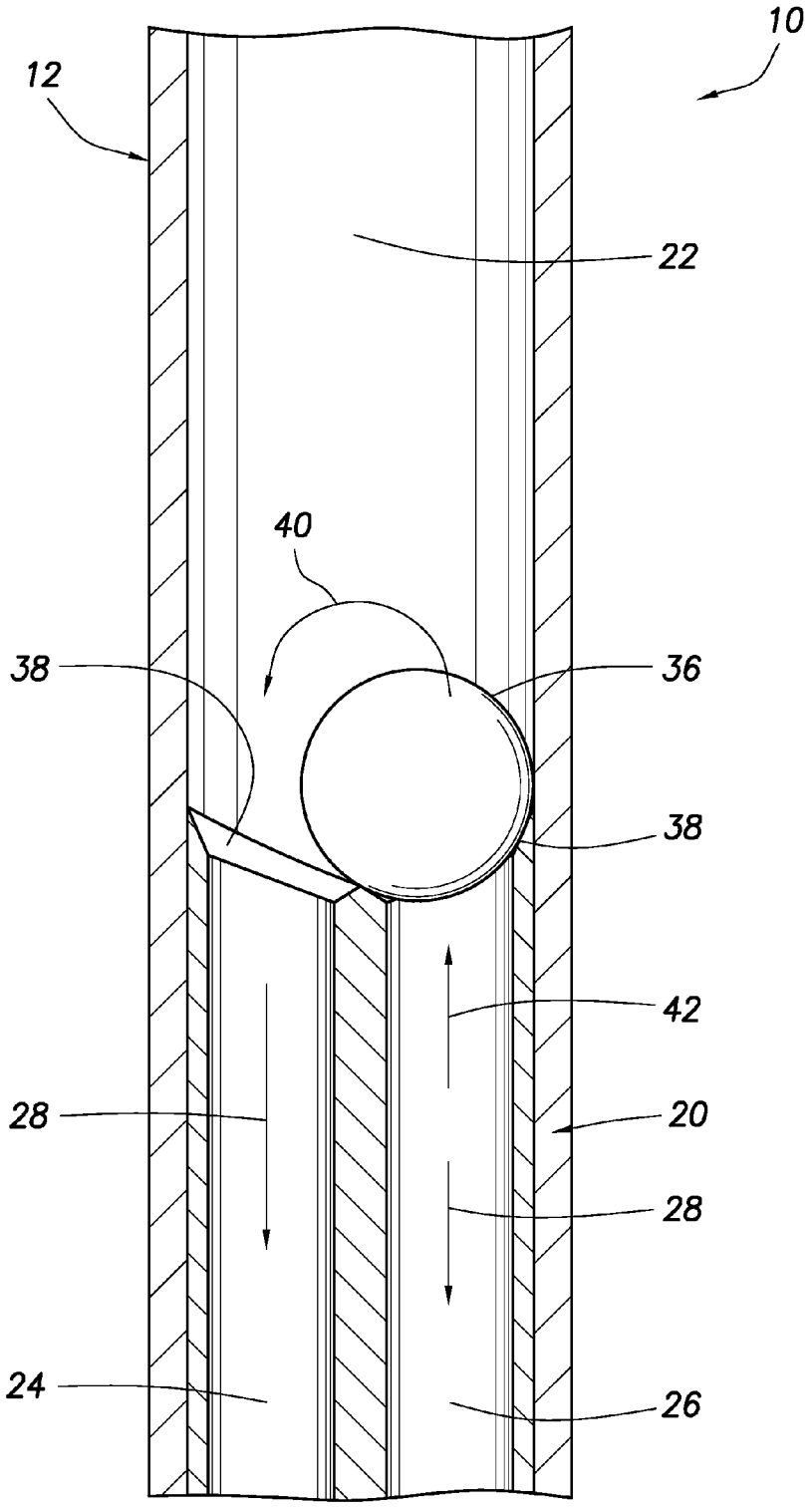

Referring additionally now to FIGS. 3-5, cross-sectional views of an upstream end of the device 20 are representatively illustrated after a blocking member 36 has been discharged, launched or released into the passage 22. An apparatus known to those skilled in the art as a "ball launcher" may be used to discharge the blocking member 36 into the passage 22, although other apparatus and methods may be used for this purpose in keeping with the scope of this disclosure.

The member 36 is depicted in FIGS. 3-5 in the form of a ball or sphere suitable for sealing engagement with ball seats 38 formed at upstream ends of the flow paths 24, 26. In other examples, the member 36 could be in the form of another plug or a valve, and the seats 38 could be suitably shaped to sealingly engage such other plug or valve. Thus, it will be appreciated that the scope of this disclosure is not limited to use of any particular form of blocking member and/or seats.

The member 36 is discharged into the passage 22 when it is desired to induce the vibrations in the tubular string 12. In some examples, the member 36 could be positioned in the passage 22 when the tubular string 12 is initially installed in the wellbore 14, or the member could be discharged into the passage only when difficulty is encountered in displacing the tubular string in the wellbore.

In some examples, the member 36 could be pre-installed in the device 20, or installed after a difficulty is encountered. The member 36 could be initially latched in the tubular string 12 or device 20 using equipment, such as, locating nipples well known to those skilled in the art.

Prior to the member 36 being introduced into the passage 22, the fluid 28 can flow relatively equally through the flow paths 24, 26, as depicted in FIG. 3. Since, in this example, the combined flow areas of the flow paths 24, 26 is less than that of the passage 22, a velocity of the fluid 28 will increase as it flows into the flow paths. In other examples, the combined flow areas of the flow paths 24, 26 could be equal to, or greater than, the flow area of the passage 22.

In the FIG. 3 illustration, the blocking member 36 displaces through the passage 22 with the flow of the fluid 28. The member 36 has not yet arrived at the seats 38 of the device 20.

In the FIG. 4 illustration, the member 36 has sealingly engaged one of the seats 38, and thereby blocks flow through the flow path 24. Note that it is not necessary for the member 36 to completely prevent all flow from the passage 22 to the flow path 24. The blocking member 36 could alternatively first engage the seat 38 which is at an upstream end of the flow path 26.

Due to the member 36 blocking flow of the fluid 28 into the flow path 24, the velocity of the fluid in the flow path suddenly decreases. Concurrently, the flow of the fluid 28 through the other flow path 26 increases.

It will be appreciated by those skilled in the art that, due to the well known Bernoulli effect, localized pressure on a side of the member 36 facing the flow path 26 will decrease as the velocity of the fluid 28 through the flow path 26 increases. Thus, a pressure differential across the member 36 will tend to bias the member toward the flow path 26 (as indicated by arrow 40).

In addition, it is expected that the velocity of the fluid 28 in the flow path 24 will eventually decrease to zero, and then reverse direction (as indicated by arrow 42). This flow reversal in the flow path 24 will allow the member 36 to disengage from the seat 38 at the upstream end of the flow path 24 and displace (in response to the Bernoulli effect pressure differential 40) into engagement with the seat 38 at the upstream end of the flow path 26, as depicted in FIG. 5.

When the member 36 engages the seat 38 and thereby blocks flow from the passage 22 into the flow path 26, the velocity of the fluid 28 in the flow path 26 will quickly decrease, and the flow of the fluid in the flow path 24 will increase. The increased velocity of the fluid 28 through the flow path 24 will cause the member 36 to be biased back toward the flow path 24 (due to the Bernoulli effect pressure differential 40), similar to the situation depicted in FIG. 4, but reversed.

However, since the velocity of the fluid 28 in the flow path 26 at the time the member 36 engaged the seat 38 at the upstream end of the flow path 26 (as depicted in FIG. 5) was greater than the velocity of the fluid in the flow path 24 at the time the member initially engaged the seat at the upstream end of the flow path 24 (as depicted in FIG. 4), it will take longer for the velocity of the fluid in the flow path 26 to decrease to zero, and then reverse direction. Once the flow of the fluid 28 in the flow path 26 does reverse direction, the member 36 can displace back into engagement with the seat 38 at the upstream end of the flow path 24, and this process will repeat, with the member 36 repeatedly and alternately engaging the seats.

After the member 36 has engaged a second one of the seats 38 (the seat at the upstream end of the flow path 26 in this example), the member will alternately block flow through the flow paths 24, 26 at a certain frequency. This frequency is given by the following equation:

$$f=(c/2)/L \tag{1}$$

where f is the frequency of the vibrations imparted to the tubular string 12 by the device 20, c is a speed of sound in the fluid 28, and L is a length of the flow paths 24, 26.

If the fluid 28 comprises substantially water, and the length L is approximately 30 feet (~9 meters), then the frequency f may be approximately 83 Hz. Of course, the length L of the flow paths 24, 26 can be altered to produce any desired frequency f for a given fluid 28. If cavitation occurs when the flow of the fluid 28 is suddenly blocked by the member 36, it is expected that the frequency f will be substantially less than that predicted by equation (1) above.

The member 36 suddenly blocks a longitudinal flow of the fluid 28 when it engages each of the seats 38, and so a substantial decrease in longitudinal momentum is experienced at these times. Since each seat 38 is laterally offset from a center of the tubular string 12, this loss of fluid 28 momentum results in a moment being applied to the tubular string.

The moment repeatedly reverses direction as the member 36 blocks flow through alternate ones of the flow paths 24, 26. This reversing vibratory moment applied to the tubular string 12 can assist substantially in displacing the tubular string through the wellbore 14.

Note that the device 20 (including the member 36) can be made of materials which can be dissolved or otherwise degraded, for example, by acid pumped during a stimulation operation. Alternatively, or in addition, the device 20 can be made of relatively easily milled or drilled materials (such as, aluminum or mild steel). In some examples, the member 36 could be reverse circulated out of the tubing string 12 when assistance with displacing the tubular string through the wellbore 14 is no longer needed and/or desired. If the device 20 is appropriately equipped with a fishing neck (not shown), and positioned in a suitable nipple profile (not shown), the device could be fished out or removed from the tubular string 12 when it is no longer needed.

It may now be fully appreciated that the above disclosure provides significant advances to the art of assisting displacement of tubular strings through wellbores and other restricted spaces. In one example described above, the displacement assistance device 20 can be used to induce a relatively low frequency and high amplitude reversing moment vibration to the tubular string 12, in order to assist with displacement of the tubular string through the wellbore 14.

A tubular string displacement assistance device 20 is provided to the art by the above disclosure. In one example, the device 20 can include at least first and second flow paths 24, 26 in fluid communication with a flow passage 22, and a blocking member 36 that blocks flow through the first flow path 24 in response to the flow through the first flow path 24, and blocks flow through the second flow path 26 in response to the flow through the second flow path 26.

The flow passage 22 in this example may have a greater flow area as compared to a flow area of each of the first and second flow paths 24, 26.

The blocking member 36 can prevent fluid flow from the flow passage 22 to a respective one of the first and second flow paths 24, 26 when the blocking member 36 blocks the respective one of the first and second flow paths 24, 26. In some examples, the blocking member 36 may not completely prevent such fluid flow.

The blocking member 36 may alternately block the flows through the first and second flow paths 24, 26.

The first and second flow paths 24, 26 may be parallel to each other. In an example described above, the flow paths 24, 26 are laterally offset from a center of the flow passage 22

The blocking member 36 is preferably not secured against longitudinal displacement through the flow passage 22. The blocking member 36 may be launched or discharged for longitudinal displacement through the passage 22 when desired.

The blocking member 36 can sealingly engage a seat 38 at an upstream end of each of the first and second flow paths 24, 26. The seats 38 may be laterally offset from a center of the flow passage 22.

Also described above is a method of assisting displacement of a tubular string 12. In one example, the method can comprise: installing the tubular string 12; then discharging a blocking member 36 into the tubular string 12; and flowing a fluid 28 through a flow passage 22 extending longitudinally through a displacement assistance device 20 connected in the tubular string 12, the flowing causing the blocking member 36 to repeatedly block flow of the fluid 28 through at least first and second flow paths 24, 26 of the device 20 in succession.

The installing step can include installing the tubular string 12 in a portion of a wellbore 14 that is substantially inclined relative to vertical.

The installing step can include connecting a drill bit 32 at a distal end of the tubular string 12.

The tubular string 12 may comprise a coiled tubing string 34.

The blocking member 36 may block the flow of the fluid 28 through the first flow path 24 in response to the flow of the fluid 28 through the first flow path 24, and the blocking member 36 may block the flow of the fluid 28 through the second flow path 26 in response to the flow of the fluid 28 through the second flow path 26.

The blocking member 36 may alternately block flow of the fluid 28 through the first and second flow paths 24, 26. The blocking member 36 may sealingly engage a seat 38 at an upstream end of each of the first and second flow paths 24, 26.

A system 10 for use with a subterranean well is also described above. In one example, the system 10 can include a displacement assistance device 20 connected in a tubular string 12, the displacement assistance device 20 including at least first and second flow paths 24, 26 in fluid communication with a flow passage 22 extending through the tubular string 12, and a blocking member 36 that alternately blocks flow through the first and second flow paths 24, 26 in response to flow through the flow passage 22.

The blocking member 36 may block flow through the first flow path 24 in response to the flow through the first flow path 24, and may block flow through the second flow path 26 in response to the flow through the second flow path 26.

A flow velocity in each of the first and second flow paths 24, 26 when unblocked by the blocking member 36 can be greater than a flow velocity in the flow passage 22.

The device 20 may be connected in the tubular string 12 without the blocking member 36 installed in the device 20.

The tubular string 12 may comprise a coiled tubing string 34. The tubular string 12 may comprise a drill string.

The tubular string 12 may be positioned in a wellbore 14 that is substantially inclined relative to vertical.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A tubular string displacement assistance device, comprising:

at least first and second flow paths in fluid communication with a flow passage; and a blocking member that blocks flow through the first flow path in response to the flow through the first flow path, and blocks flow through the second flow path in response to the flow through the second flow path, wherein change of blocking through the first flow path and change of blocking through the second flow path follows reversal of flow in the respective first flow path or second flow path.

2. The device of claim 1, wherein the flow passage has a greater flow area as compared to a flow area of each of the first and second flow paths.

3. The device of claim 1, wherein the blocking member prevents fluid flow from the flow passage to a respective one of the first and second flow paths when the blocking member blocks the respective one of the first and second flow paths.

4. The device of claim 1, wherein the blocking member alternately blocks the flows through the first and second flow paths.

5. The device of claim 1, wherein the first and second flow paths are parallel to each other.

6. The device of claim 1, wherein the blocking member is not secured against longitudinal displacement through the flow passage.

7. A tubular string displacement assistance device, comprising:

at least first and second flow paths in fluid communication with a flow passage; and a blocking member that blocks flow through the first flow path in response to the flow through the first flow path, and blocks flow through the second flow path in response to the flow through the second flow path, wherein the blocking member sealingly engages a seat at an upstream end of each of the first and second flow paths.

8. A method of assisting displacement of a tubular string, the method comprising:

installing the tubular string;

then discharging a blocking member into the tubular string; and flowing a fluid through a flow passage extending longitudinally through a displacement assistance device connected in the tubular string, the flowing causing the blocking member to repeatedly block flow of the fluid through at least first and second flow paths of the device in succession, wherein change of blocking through the first flow path and change of blocking through the second flow path follows reversal of flow in the respective first flow path or second flow path.

9. The method of claim 8, wherein the installing further comprises installing the tubular string in a portion of a wellbore that is substantially inclined relative to vertical.

10. The method of claim 8, wherein the installing further comprises connecting a drill bit at a distal end of the tubular string.

11. The method of claim 8, wherein the tubular string comprises a coiled tubing string.

12. The method of claim 8, wherein the blocking member blocks the flow of the fluid through the first flow path in response to the flow of the fluid through the first flow path, and wherein the blocking member blocks the flow of the fluid through the second flow path in response to the flow of the fluid through the second flow path.

13. The method of claim 8, wherein the blocking member alternately blocks flow of the fluid through the first and second flow paths.

14. A method of assisting displacement of a tubular string, the method comprising:

installing the tubular string;

then discharging a blocking member into the tubular string; and flowing a fluid through a flow passage extending longitudinally through a displacement assistance device connected in the tubular string, the flowing causing the blocking member to repeatedly block flow of the fluid through at least first and second flow paths of the device in succession, wherein the blocking member sealingly engages a seat at an upstream end of each of the first and second flow paths.

15. A system for use with a subterranean well, the system comprising:

a displacement assistance device connected in a tubular string, the displacement assistance device including at least first and second flow paths in fluid communication with a flow passage extending through the tubular string, and a blocking member that alternately blocks flow through the first and second flow paths in response to flow through the flow passage wherein change of blocking through the first flow path and change of blocking through the second flow path follows reversal of flow in the respective first flow path or second flow path.

16. The system of claim 15, wherein the blocking member blocks flow through the first flow path in response to the flow through the first flow path, and blocks flow through the second flow path in response to the flow through the second flow path.

17. The system of claim 15, wherein a flow velocity in each of the first and second flow paths when unblocked by the blocking member is greater than a flow velocity in the flow passage.

18. The system of claim 15, wherein the device is connected in the tubular string without the blocking member installed in the device.

19. The system of claim 15, wherein the tubular string comprises a coiled tubing string.

20. The system of claim 15, wherein the tubular string comprises a drill string.

21. The system of claim 15, wherein the tubular string is positioned in a wellbore that is substantially inclined relative to vertical.

* * * * *